United States Patent [19]

Figiel et al.

[11] 4,383,645

[45] May 17, 1983

[54] VAPOR SPRAYER AND PROCESS FOR PROVIDING A VOLATILE FLUID AS A VAPOR SPRAY

[75] Inventors: Francis J. Figiel, Boonton; Harry F. Osterman, Westfield, both of N.J.

[73] Assignee: Allied Corporation, Morris Township, Morris County, N.J.

[21] Appl. No.: 216,046

[22] Filed: Dec. 15, 1980

[51] Int. Cl.[3] ..... B05B 1/24

[52] U.S. Cl. ..... 239/13; 239/128

[58] Field of Search ..... 239/128, 132.1, 133, 239/135, 136, 139, 13; 165/DIG. 5

[56] References Cited

U.S. PATENT DOCUMENTS

| | | | |
|---|---|---|---|
| 2,128,263 | 8/1938 | Ofeldt | 239/75 |
| 2,391,177 | 12/1945 | Malsbary et al. | 239/128 X |
| 2,790,063 | 4/1957 | Bok et al. | 239/128 X |
| 3,720,373 | 3/1973 | Levey | 239/127 |
| 3,997,114 | 12/1976 | Hewett | 239/127 |
| 4,204,612 | 5/1980 | Schrader et al. | 239/128 X |

FOREIGN PATENT DOCUMENTS

| | | | |
|---|---|---|---|
| 384667 | 12/1932 | United Kingdom . | |
| 517395 | 7/1938 | United Kingdom . | |
| 517459 | 7/1938 | United Kingdom . | |
| 509257 | 7/1939 | United Kingdom | 165/DIG. 5 |
| 636324 | 4/1950 | United Kingdom . | |
| 928644 | 9/1959 | United Kingdom . | |
| 964339 | 4/1961 | United Kingdom . | |
| 1209205 | 5/1968 | United Kingdom . | |
| 1360631 | 1/1971 | United Kingdom . | |
| 1406667 | 9/1972 | United Kingdom . | |
| 2006049 | 10/1978 | United Kingdom . | |
| 2053741 | 7/1979 | United Kingdom . | |
| 2032984 | 9/1979 | United Kingdom . | |

OTHER PUBLICATIONS

Industrial Paint Application, 2nd Edition by W. H. Tappon & E. W. Drew–published by Newnes–Butterworth, pp. 116–118.

*Primary Examiner*—Andres Kashnikow
*Assistant Examiner*—Gene A. Church
*Attorney, Agent, or Firm*—Arthur J. Plantamura; Jay P. Friedenson

[57] ABSTRACT

The present invention provides a novel apparatus and process for generating a vapor spray from a volatile fluid. In the invention, the volatile fluid is heated to a temperature just below its boiling point prior to being discharged from heat exchanger (18, 46). In one embodiment of the apparatus, heat exchanger (46) contains a diffusion plate (48) to ensure that the volatile fluid is at the selected temperature when discharged from the heat exchanger. In this embodiment, the apparatus further includes a pressure-responsive valve (40) and a bypass line (42) so that a selected pressure is maintained downstream from pump (34).

The novel process of the present invention includes the step of heating the volatile fluid within heat exchanger (18, 46) to a selected temperature just below its boiling point prior to discharge from the heat exchanger. In one embodiment, the process further includes the step of impinging the volatile fluid stream as it enters heat exchanger (46) onto diffusion plate (48) so that it is ensured that the volatile fluid is at the selected temperature upon discharge. In this embodiment, passing of the fluid drawn from reservoir (32) is accompanied by modulating the flow of the drawn fluid through bypass line (42) connecting pump (34) and reservoir (32), whereby a selected pressure is maintained downstream from pump (34).

16 Claims, 2 Drawing Figures

VAPOR SPRAYER AND PROCESS FOR PROVIDING A VOLATILE FLUID AS A VAPOR SPRAY

TECHNICAL FIELD

This invention relates to a novel apparatus and process for providing a volatile fluid as a vapor spray and specifically relates to the use of a less aggressive solvent for solvent cleaning applications.

BACKGROUND ART

Heat generation of vapor spray is known. Illustrative of this type of prior art are U.S. Pat. No. 2,128,263 to Ofeldt and U.S. Pat. No. 2,790,063 to Bok et al. The Ofeldt patent shows an apparatus for generating a spray in which the fluid to be sprayed is passed through a heating coil 4. Heat is provided to the heating coil using a fire pot. The vapor sprayer of Bok includes an easily transportable reservoir having electrical heating means provided within the reservoir. The electrical heating means is immersed directly into the fluid to be vaporized.

This prior art and the other prior art of which we are aware fails to provide an apparatus and process for generating a vapor spray from a volatile fluid that heats the volatile fluid within a heat exchanger in which the fluid is exterior to a heating element, that is capable of producing a continuous vapor spray, that modulates flow of the fluid prior to entry thereof into the heat exchanger whereby a selected pressure is maintained downstream from a pump drawing the fluid from a reservoir, and that controls the velocity of the stream of fluid as it enters the heat exchanger so as to ensure that the fluid is at a selected temperature when discharged from the heat exchanger.

DISCLOSURE OF THE INVENTION

It is accordingly one object of the present invention to provide a novel apparatus and process that heats the volatile fluid within a heat exchanger in which the volatile fluid is exterior to a heating element and that is capable of producing a continuous vapor spray.

A further object of the present invention is to provide an apparatus and process of this type that modulates flow of the fluid prior to entry thereof into the heat exchanger whereby a selected pressure is maintained downstream from a pump drawing the fluid from a reservoir, and that controls the velocity of the stream of fluid as it enters the heat exchanger so that it is ensured that the fluid is at a selected temperature when discharged from the heat exchanger.

Additional objects, advantages and novel features of the invention will be set forth in the description which follows, and in part, will become apparent to those skilled in the art upon examination of the following, or may be learned by practice of the invention. The objects and advantages of the invention may be realized and attained by means of instrumentalities and combinations particularly pointed out in the appended claims.

To achieve the foregoing objects and in accordance with the purpose of the invention, as embodied and broadly described herein, the present invention is directed to a vapor sprayer. The vapor sprayer includes a reservoir, a pump, a heat exchanger, a discharge valve and at least one nozzle.

The reservoir is adapted to contain a volatile fluid, and the pump serves to draw the volatile fluid from the reservoir. The heat exchanger contains a heating element adapted to heat the volatile fluid to selected temperature just below its boiling point. The heating element has heat output control means. The volatile fluid is in heat-transfer relationship with and exterior to the heating element as it passes through the heat exchanger. The pump is situated between and is in fluid communication with the reservoir and the heat exchanger.

The discharge valve serves to discharge the heated fluid from the heat exchanger. The heated fluid is at the selected temperature when discharged. The discharge valve is in fluid communication with the heat exchanger and the nozzle. The nozzle delivers the discharged as a vapor spray.

In one embodiment, the heat exchanger is dimensioned so as to serve primarily as a conduit through which the volatile fluid passes as it is heated, and the discharge valve is an adjustable valve that provides the discharged fluid at a selected pressure to the nozzle.

In another embodiment, the heat exchanger is dimensined so as to serve as a storage chamber for the volatile fluid. The heat exchanger contains a diffusion plate for spreading over a large area, the fluid stream as it enters the heat exchanger. The diffusion plate is located proximate the incoming stream, whereby the velocity of the incoming stream is substantially diminished so that it is ensured that the volatile fluid is at the selected temperature when discharged from the heat exchanger. The heat exchanger is positioned so that the diffusion plate is situated in a lower region thereof.

In the latter embodiment, the vapor sprayer further includes a pressure-responsive valve that modulates flow of the fluid drawn by the pump through a bypass line connecting the pump and the reservoir, thereby maintaining a selected pressure downstream from the pump. The discharge valve of this embodiment is capable of being set either in an open position or a closed position.

Also provided is a process for generating a vapor spray from a volatile fluid. The process includes the step of drawing a volatile fluid from a reservoir adapted to contain the volatile fluid. Then, at least a portion of the drawn fluid is passed to a heat exchanger containing a heating element adapted to heat the volatile fluid to a selected temperature just below its boiling point. The heating element has heat output control means. Next, the volatile fluid is heated within the heat exchanger to the selected temperature. The volatile fluid is in heat-transfer relationship with and exterior to the heating element during the heat step. The heated fluid is then discharged at the selected temperature from the heat exchanger, and the discharged fluid is delivered as a vapor spray through at least one nozzle.

In one embodiment, the heat exchanger is dimensioned so as to primarily serve as a conduit through which the volatile fluid passes as it is heated, and the heated fluid is discharged using an adjustable valve that provides the discharged fluid at a selected pressure.

In another embodiment, the heat exchanger is dimensioned so as to serve as a storage chamber for the volatile fluid, and the heat exchanger is positioned so that a diffusion plate located within the heat exchanger is situated in a lower region thereof. In this embodiment, the process further includes the step of impinging the volatile fluid stream as it enters the heat exchanger onto the diffusion plate, which is located proximate the incoming stream, whereby the velocity of the incoming stream is substantially diminished so that mixing is reduced and it is ensured that the volatile fluid is at the selected temperature when discharged from the heat exchanger. Additionally, in this embodiment, passing of the drawn fluid to the heat exchanger is accompanied by modulating flow of the drawn fluid through a bypass line connecting the pump and the reservoir, whereby a selected pressure is maintained downstream from the pump. The heated fluid is discharged from the heat exchanger using a discharge valve capable of being set either in an open position or a closed position.

BRIEF DESCRIPTION OF THE DRAWING

Reference is hereby made to the accompanying drawing which forms a part of the specification of this application.

BEST MODE FOR CARRYING OUT THE INVENTION

Figure 1:
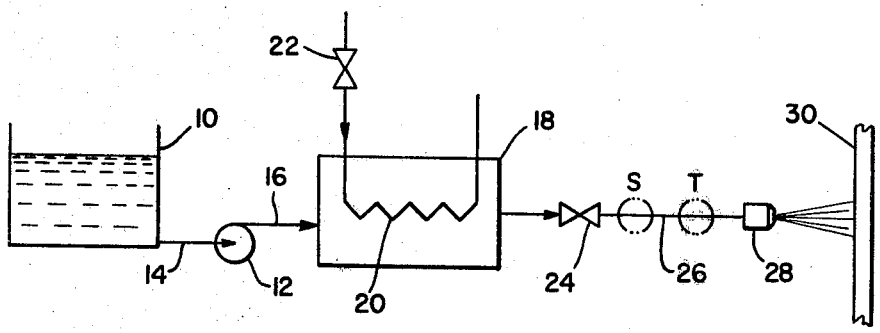
FIG. 1 depicts an embodiment of the present invention particularly suitable for continuous flow applications.

As explained above, in accordance with the invention, there is provided a novel vapor sprayer and process for providing a volatile liquid as a vapor spray. The vapor spray is used for solvent cleaning applications such as removal of solder flux residue from P/C board assemblies or of paste residue from hybrid circuits. A particular advantage of the invention is that it enables the vapor spray to be formed from a less aggressive solvent such as trichlorofluoroethane. The apparatus and process, as explained in detail below, provide the vapor spray by heating the volatile fluid to a temperature just below its boiling point prior to discharge from a heat exchanger.

The invention will now be described with reference to the embodiment shown in FIG. 1 of the drawing. This embodiment is particularly suitable for continuous flow applications, and is especially designed to operate at steady state with a constant fluid flow rate and a constant heat output by the heating element thereof. In this embodiment, a vapor sprayer in accordance with the invention, includes a reservoir, a pump, a heat exchanger, a discharge valve and at least one nozzle for delivering the discharged fluid as a vapor spray.

In vapor degreasing, a degreasing solvent is used to remove contaminants such as lubricants from work pieces. The degreasing solvent is vaporized in a still, condensed and removed from the still during the process. A reservoir, in accordance with the invention, contains a volatile fluid and may be a degreaser sump or a distilled solvent reservoir. As indicated above, the present invention has broad solvent cleaning applications, and the reservoir could, for example, also be a separate tank.

The pump is conventional, and is situated between the reservoir and a heat exchanger. The pump draws the volatile fluid from the reservoir and feeds it to the heat exchanger. Conveniently, the pump is a centrifugal pump so that as downstream pressure increases, the pump output decreases. Altneratively, the pump could be a positive displacement pump. However, if a positive displacement pump were used, then the vapor sprayer should be modified to include a bypass line and a pressure-responsive valve of the type described below with regard to FIG. 2. Although the FIG. 1 embodiment could be modified to include the bypass line and pressure-responsive valve when the centrifugal pump is used, no substantial advantage is gained.

The heat exchanger of this embodiment is dimensioned so as to serve primarily as a conduit through which the volatile fluid passes as it is heated. Suitably, a tube is used as the heat exchanger. The heat exchanger contains a heating element adapted to heat the volatile fluid to a selected temperature just below its boiling point. The volatile fluid is in heat-transfer relationship with and exterior to the heating element as it passes through the heat exchanger. The heating element conveniently is a pipe through which a hot fluid such as steam or hot water is passed or is an electric coil. The heating element functions to raise the incoming fluid to a temperature just below its boiling point prior to discharge from the heat exchanger. The heat output of the heating element is suitably controlled by using a valve when the heating element is the pipe and by using a rheostat when the heating element is the electric coil.

The heated fluid is discharged from the heat exchanger through a discharge valve. In this embodiment, it is preferred that the valve is an adjustable valve. The valve is set to provide the discharged fluid at a selected pressure to the nozzle. The heated fluid is at the selected temperature when discharged from the heat exchanger. The nozzle delivers the discharged fluid as a vapor spray. As indicated above, one or more nozzles are used.

The adjustable valve and the nozzle combine to control the fluid flow rate. Once the valve has been adjusted to provide a desired pressure and the appropriate nozzle or nozzles have been selected or adjusted, the flow rate will be constant. Then, the heat output of the heating element is set so that the temperature of the solvent discharged from the heat exchanger is at a selected temperature just below its boiling point. As a result, the vapor sprayer will operate in a steady state to provide a continuous stream of vapor spray. It is, of course, understood that the temperature of the fluid drawn from the reservoir must remain constant.

In the event that the fluid flow rate or the temperature of the drawn fluid is subject to variation, the vapor sprayer should include a temperature control device such as a thermostat. The temperature control device would function to ensure that the heated fluid is discharged at the selected temperature by operating the device controlling output of the heating element.

Preferably, the vapor sprayer includes a pressure gauge located downstream from the discharge valve. Conveniently, the pressure gauge is located at the nozzle, as a result of which the pressure measured is at the nozzle.

As can be seen from the above description, the vapor sprayer heats the volatile fluid to a temperature just below its boiling point and delivers the heated fluid at a selected pressure to the nozzle. The fluid is then discharged through the nozzle as a vapor spray.

A process for providing a volatile fluid as a vapor spray using the apparatus of FIG. 1, will now be described. In the first essential step of the process, in accordance with the invention, a volatile fluid is drawn from the reservoir. In accordance with the invention, in the next step, the drawn fluid is passed to the heat exchanger. In the third essential step, the fluid stream is heated within the heat exchanger to a selected temperature just below its boiling point. During this heating step, the volatile fluid is in heat-transfer relationship with and exterior to the heating element contained within the heat exchanger.

In accordance with the invention, in the next essential step, the heated fluid is discharged from the heat exchanger. The heated fluid is at the selected temperature when discharged. In the fifth essential step, the fluid is delivered through the nozzle as a vapor spray to impinge on a work piece.

Modifications in the process result to the extent that the modifications described above are made in the vapor sprayer of FIG. 1. Thus, for example, the temperature of the heated fluid could be measured and the heat output control device be regulated in response to the temperature sensed. Also, the pressure of the discharged fluid could be measured.

The invention will now be described with reference to the embodiment shown in FIG. 2 of the drawing. In this embodiment, a vapor sprayer in accordance with the present invention, includes a reservoir, a pump, a pressure-responsive valve for modulating flow of the drawn fluid through a bypass line and thereby maintaining a selected pressure downstream from the pump, a heat exchanger containing a heating element, a discharge valve, and at least one nozzle for delivering the discharged fluid as a vapor spray. This embodiment of the invention is suitable to provide a ready reserve of hot solvent for use on demand or to provide a continuous flow of hot solvent.

The reservoir, the heating element, and the nozzle are the same as that described above with reference to FIG. 1. Conveniently, the pump is either a conventional positive displacement pump or conventional centrifugal pump. The pump is downstream from the reservoir, and is upstream from the pressure-responsive valve and the heat exchanger. The pump draws the volatile fluid from the reservoir and feeds it downstream.

The pressure-responsive valve modulates flow of the drawn fluid through a bypass line containing the pressure-responsive valve and connecting the pump and the reservoir. In operation, once the vapor sprayer has reached the steady state, in the event there is no demand for the vapor spray, the pressure-responsive valve returns all the drawn solvent to the reservoir. The pressure-responsive valve operates by opening or closing in response to the pressure downstream from the pump. It is particularly preferable to use a slightly oversized pump in combination with the pressure-responsive valve since it is possible to provide a constant pressure at the nozzle over a broad range of flow rates. A further advantage of the pressure-responsive valve is that it prevents heat build up when there is not any demand for the vapor spray.

The vapor sprayer of this embodiment could be modified to remove the pressure-responsive valve and the bypass line and to add a pressure-regulating valve between the pump and the heat exchanger. However, in this case, it would be necessary to use a centrifugal pump.

The heat exchanger is dimensioned so as to serve as a storage chamber for the volatile fluid. The heat exchanger contains a diffusion plate for spreading over a large area, the fluid stream as it enters the heat exchanger. The diffusion plate is located proximate the incoming stream. Use of the diffusion plate results in the velocity of the incoming stream being substantially diminished so that mixing of the incoming cold fluid and of heated fluid is reduced and it is ensured that the volatile fluid is at a selected temperature just below its boiling point when discharged from the heat exchanger. The heat exchanger is positioned so that the diffusion plate is located in a lower region thereof. As shown in the Figure, vertical positioning of the heat exchanger is preferable.

The diffusion plate has dimensions that enable it to fit snugly within the heat exchanger and has a substantially level surface that contains a plurality of apertures. The number and size of the apertures is selected to optimize spreading of the incoming stream. The optimum number and optimum diameter depends upon factors such as the flow rate, which in turn depends upon the number of output nozzles. A suitable aperture size is in the range of about 1/16 of an inch or slightly less. The diffusion plate enables the heat exchanger to serve as a reservoir and yet to be relatively small. By virtue of the impact of the solvent stream on the plate the solvent stream is broken up and distributed, i.e., the incoming stream is dispersed and attainment of the selected temperature of the solvent just below its boiling point is expedited. Without the diffusion plate, the heat exchanger would have to be of very large size in order for it to be ensured that the volatile fluid is at the selected temperature when discharged from the heat exchanger.

The heated fluid is discharged from the heat exchanger through the discharge valve. The discharge valve is capable of being set either in an open position or a closed position. The heated fluid is at the selected temperature when discharged from the heat exchanger. Thus, when spray is required, the discharge valve is opened and hot fluid is delivered to the nozzle.

The heat output control device is the same as that described for the previous embodiment. Preferably, the heat output control device is modulated by a temperature controlling device such as a thermostat. The temperature controlling device is located within the heat exchanger, preferably near the mid-line of the heat exchanger. When there is not any demand for spray, the temperature controlling device reduces the heat output of the heating element so that the heated fluid is maintained at the selected temperature.

The pressure-responsive valve and the nozzle combine to control the fluid flow rate. As can be seen from the description of the embodiment in FIG. 2, the vapor sprayer thereof heats the volatile fluid to a selected temperature just below its boiling point prior to discharge from the heat exchanger, and delivers the heated fluid at a selected pressure to the nozzle. The heated fluid then exits the nozzle as a vapor spray to contact a work piece.

A process for providing a volatile fluid as a vapor spray using the apparatus of FIG. 2, will now be described. In the first essential step, in accordance with the invention, a volatile fluid is drawn from the reservoir. In accordance with the invention, in the second step, at least a portion of the drawn fluid is passed to the heat exchanger. In this embodiment, passing of the drawn fluid is accompanied by modulation of the flow of the drawn fluid through a bypass line connecting the pump and the reservoir, whereby a selected pressure is maintained downstream from the pump. Flow modulation is achieved using the pressure-responsive valve. In the third essential step, the fluid stream is impinged onto the diffusion plate, as the stream enters the heat exchanger. As a result, the velocity of the incoming stream is substantially diminished so that mixing is reduced, and it is ensured that the volatile fluid is at the selected temperature when discharged from the heat exchanger.

In accordance with the invention, in the fourth essential step, the volatile fluid is heated within the heat exchanger to the selected temperature. During this heating step, the volatile fluid is in heat-transfer relationship with and exterior to the heating element. In the next essential step, the heated fluid is discharged from the heat exchanger through the discharge valve, which is in the open position. The heated fluid is at the selected temperature when discharged. In accordance with the invention, in the next essential step, the discharged fluid is delivered as a vapor spray by the nozzle.

Preferably, this process includes the step of measuring the temperature of the heated fluid within the heat exchanger and automatically modulating the heat output control device in response to the temperature sensed.

Modifications in the process result to the extent that the modifications described above are made in the vapor sprayer apparatus. Thus, for example, passing of the drawn fluid to the heat exchanger could be modulated by a pressure-regulating valve, rather than by using the pressure-responsive valve and bypass line, provided that the pump were a centrifugal pump.

As noted above, a particular advantage of the present invention is that it enables the vapor spray to be formed from a less aggressive solvent. By the term "less aggressive solvent" is meant a solvent that is relatively ineffective at room temperature and useful when heated to a temperature just below its boiling point, for various cleaning purposes such as dissolving solder flux residue or removing paste residue from hybrid circuits during a conventional time-restricted solvent spray and/or vapor cleaning sequence. Exemplary less aggressive solvents are trichlorotrifluoroethane and mixtures thereof with lower alkyl alcohols or ketones. By "lower alkyl" is meant that from 1 to about 4 carbon atoms are present.

The use of a less aggressive solvent for cleaning purposes is desirable since this solvent is safer more compatible with plastic substrates, and less energy intensive than the conventionally used chlorinated solvents. Hot, warm or boiling chlorinated solvents are very active and attack electronic substrates causing distortion of plastic material. The use of chlorinated solvents has been made possible by providing vapor spray degreasers with built-in timing devices or by using rigid operation procedures so as to prevent overexposure of the substrates to the chlorinated solvents. In contrast, the use of a less aggressive solvent eliminates the need for time or cleaning mode restrictions. Additionally, use of a less aggressive solvent results in greater solvent conservation because hot solvent sprays do not cause the collapse of a vapor blanket within a vapor degreaser and thus the chimney effect is reduced or eliminated.

Reference is now made to FIG. 1 of the drawing. In this drawing, reservoir 10 contains a volatile fluid. The volatile fluid is drawn from reservoir 10 by pump 12 through line 14. The drawn fluid is passed by line 16 from pump 12 to heat exchanger 18, which contains a heating element 20. Heating element 20 has a valve 22 for controlling heat output. The heated fluid is discharged from heat exchanger 18 through discharge valve 24, which is an adjustable valve. The discharged fluid is fed by line 26 to nozzle 28, through which it exits as a vapor spray. The spray contacts work piece 30. Shown in phantom are pressure gauge S and thermostat T. When used, the thermostat operates valve 22 to ensure that the heated fluid is discharged at a selected temperature just below its boiling point.

Figure 2:
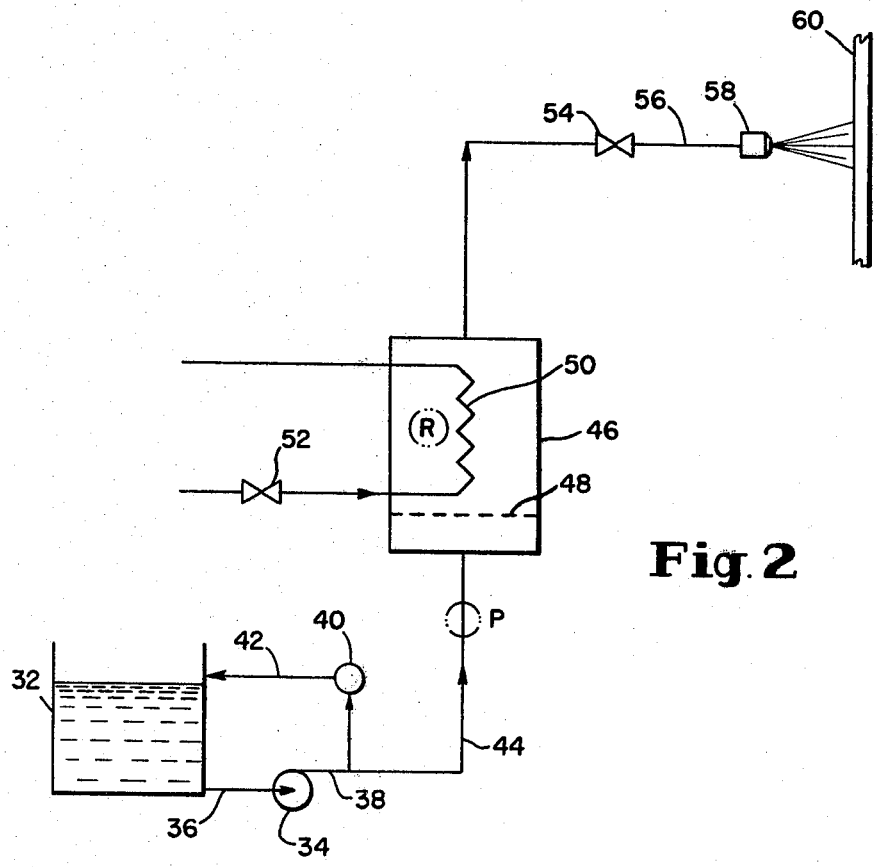
FIG. 2 depicts an embodiment of the present invention useful for either intermittent or continuous flow applications.

Reference is now made to FIG. 2 of the drawing. In this drawing, reservoir 32 contains a volatile fluid. Pump 34 draws the volatile fluid from reservoir 32 through line 36 and feeds the drawn fluid downstream through line 38. Pressure-responsive valve 40 modulates flow of the drawn fluid through bypass line 42 and thereby maintains a selected pressure downstream from pump 34. The appropriate volume of the drawn fluid is passed by line 44 to heat exchanger 46. Shown in phantom is a pressure-regulating valve P, which could be used in place of valve 40 and line 42 so long as pump 34 is a centrifugal pump.

The incoming fluid stream impinges onto diffusion plate 48, shown in cross section. The fluid is then heated to a temperature just below its boiling point by heating element 50, the heat output of which is controlled by valve 52. Shown in phantom is thermostat R, which is located about halfway up the sides of heat exchanger 46, which is vertically positioned. When thermostat R is used, it modulates valve 52 to ensure that the heated fluid is discharged at the selected temperature. The heated fluid is discharged from heat exchanger 46 through discharge valve 54, and is then passed by line 56 to nozzle 58. The hot fluid exits nozzle 58 as a spray, and contacts work piece 60. Valve 54 is an on-off valve.

In order to determine the required heat input Q to a heat exchanger, several parameters must be known. These parameters are solvent flow (gallon/hour), feed solvent temperatures (°F.), spray solvent temperature (°F.), specific heat of solvent (BTU/pound/°F.) and density (pound/gallon). The following equation shows the relationship of heat output to these parameters:

$$Q = V \times D \times SH \times (T_2 - T_1),$$

wherein V is the solvent flow, D is the density, SH is the specific heat of the solvent, $T_2$ is the spray solvent temperature and $T_1$ is the feed solvent temperature.

Using this equation, if for example it were desired to spray a work piece with trichlorotrifluoroethane at a temperature of 115° F. ($T_2$) from a reservoir at 72° F. ($T_1$) at a rate of 60 gallons/hour (V), the required heat output is 7,097.6 BTU/hour. The specific heat of trichlorotrifluoroethane is 0.21 BTU/pound/°F. and its density is 13.1 pound/gallon. Assuming electric heat, an input of 2.08 KW would be required.

The vapor sprayer of FIG. 1 is exemplified by a heating element of about 1 kilowatt output attached to a metal tubing of about ¾ inch diameter and having a minimum of 5 feet length, for a solvent spray volume of about 2 gallons/minute.

The above is intended to illustrate the invention and is not in any way to be interpreted as limiting the scope of the invention. Rather, it is intended that the scope of the invention be defined by the claims appended hereto.

INDUSTRIAL APPLICABILITY

The novel apparatus and process of this invention are useful for solvent cleaning applications such as removal of solder flux residue from P/C board assemblies or of paste residue from hybrid circuits. The invention enables a useful vapor spray to be formed from a less aggressive solvent such as trichlorotrifluoroethane.

We claim:

1. A volatile liquid solvent sprayer apparatus comprising a reservoir adapted to contain a volatile liquid solvent that is useful for cleansing when heated to a temperature just below its boiling point;

a pump for drawing the volatile solvent from said reservoir;

a heat exchanger containing a heating element adapted to heat the volatile solvent to a selected temperature just below its boiling point, the volatile solvent being in heat-transfer relationship with and exterior to said heating element as it passes through said heat exchanger; said pump being situated between and in fluid connection with said reservoir and said heat exchanger; said heating element having heat output control means;

a discharge valve for discharging the heated solvent from said heat exchanger, said heated solvent being at said selected temperature when discharged; said discharge valve being in fluid connection with said heat exchanger and at least one nozzle; and said at least one nozzle, which delivers the discharged solvent as a liquid spray just below the boiling point of a solvent.

2. The sprayer of claim 1, wherein said heat exchanger is dimensioned so as to serve primarily as a conduit through which the volatile solvent passes as it is heated, and wherein said discharge valve is an adjustable valve that provides said discharged solvent at a selected pressure and at said selected temperatures just below its boiling point to said at least one nozzle.

3. The solvent sprayer of claim 2, further comprising pressure sensing means for measuring the pressure of said discharged solvent, said pressure-sensing means being located downstream from said discharge valve.

4. The solvent sprayer of claim 2, further comprising a temperature controlling means for ensuring that said heated solvent is discharged at said selected temperature, said temperature controlling means being located downstream from said discharge valve, and said heat output control means being operated by said temperature controlling means.

5. The sprayer of claim 1, wherein said heat exchanger is dimensioned so as to serve as a storage chamber for the volatile solvent; wherein said heat exchanger contains a diffusion plate to promote the temperature uniformity of the solvent stream by dispersing over a large area, the solvent stream as it enters said heat exchanger, said diffusion plate being located proximate the incoming stream, whereby the velocity of said incoming stream impinging on said diffusion plate effects uniform mixing and it is ensured that the volatile solvent is at said selected temperature when discharged from said heat exchanger; and wherein said heat exchanger is positioned so that said diffusion plate is situated in a lower region thereof.

6. The solvent sprayer of claim 5, further comprising a pressure-responsive valve that modulates flow of the solvent drawn by said pump through a bypass line connecting said pump and said reservoir, thereby maintaining a selected pressure downstream from said pump; wherein said discharge valve is capable of being set either in an open position or a closed position.

7. The solvent sprayer of claim 6, further comprising a temperature control means for ensuring that said heated solvent is discharged at said selected temperature, said temperature control means being located within said heat exchanger, and said heat output control means being operated by said temperature control means.

8. The solvent sprayer of claim 1, wherein said solvent comprises trichlorotrifluoroethane.

9. A process for generating a solvent spray from a less aggresive volatile liquid solvent that is useful for cleaning when heated to a temperature just below its boiling point, said process comprising drawing a volatile solvent from a reservoir adapted to contain said less aggressive solvent;

passing at least a portion of the drawn solvent to a heat exchanger comprising a heating element adapted to heat the volatile liquid to a selected temperature just below its boiling point, said heating element having heat output control means of sufficient capacity to maintain the volatile liquid just below its boiling point;

heating the volatile liquid within said heat exchanger to said selected temperature, the volatile liquid being in heat-transfer relationship with and exterior to said heating element;

discharging the heated liquid at said selected temperature from said heat exchanger; and delivering the discharged liquid as a spray through at least one nozzle.

10. The process of claim 9, wherein said heat exchanger is dimensioned so as to primarily serve as a conduit through which the volatile solvent passes as it is heated, and wherein the heated solvent is discharged using an adjustable valve that provides the discharged solvent at a selected pressure to said at least one nozzle.

11. The process of claim 10, further comprising the step of measuring the pressure of said discharged solvent downstream from said discharge valve.

12. The process of claim 10, further comprising the step of measuring the temperature of said heated solvent downstream from said discharge valve and automatically modulating said heat output control means in response to the sensed temperature.

13. The process of claim 9, wherein said heat exchanger is dimensioned so as to serve as a storage chamber for the volatile solvent, and said heat exchanger is positioned so that a diffusion plate located within said heat exchanger is situated in a lower region thereof;

said process further comprising the step of impinging the volatile solvent stream as it enters said heat exchanger onto said diffusion plate, which is located proximate the incoming stream, whereby the velocity of said incoming stream is substantially diminished so that mixing is reduced and it is ensured that the volatile solvent is at said selected temperature when discharged from said heat exchanger.

14. The process of claim 13, wherein passing of said drawn solvent to said heat exchanger is accompanied by modulating flow of said drawn solvent through a bypass line connecting said pump and said reservoir, whereby a selected pressure is maintained downstream from said pump; said bypass line having a pressure-responsive valve; wherein said discharge valve is capable of being set either in an open position or a closed position.

15. The process of claim 14, further comprising the step of measuring the temperature of said heated solvent within said heat exchanger and automatically modulating said heat output control means in response to the sensed temperature.

16. The process of claim 9, wherein said solvent comprises trichlorotrifluoroethane.

* * * * *

UNITED STATES PATENT AND TRADEMARK OFFICE

CERTIFICATE OF CORRECTION

PATENT NO. : 4,383,645

DATED : May 17, 1983

INVENTOR(S) : Francis J. Figiel et al.

It is certified that error appears in the above–identified patent and that said Letters Patent are hereby corrected as shown below:

The title should read --SOLVENT SPRAYER AND PROCESS FOR SOLVENT SPRAYING--.

Signed and Sealed this

*Thirteenth* Day of *September 1983*

[SEAL]

*Attest:*

GERALD J. MOSSINGHOFF

*Attesting Officer*

*Commissioner of Patents and Trademarks*